US006457593B1

(12) United States Patent
Hsu

(10) Patent No.: US 6,457,593 B1
(45) Date of Patent: Oct. 1, 2002

(54) DISASSEMBLABLE ROTARY PEN EXHIBITION RACK

(76) Inventor: Ming-Tay Hsu, PO Box 82-144, Taipei (TW)

( * ) Notice: Subject to any disclaimer, the term of this patent is extended or adjusted under 35 U.S.C. 154(b) by 0 days.

(21) Appl. No.: 09/817,281

(22) Filed: Mar. 27, 2001

(51) Int. Cl.[7] ..... A47F 7/00
(52) U.S. Cl. ..... 211/69.1; 211/163; 211/70
(58) Field of Search ..... 211/69.5, 163, 211/70, 39; 248/415, 430

(56) References Cited

U.S. PATENT DOCUMENTS 311,613 A * 2/1885 Shelden
4,688,685 A * 8/1987 Brace ..... 211/60.1 X
4,773,544 A * 9/1988 McCarthy ..... 211/69.1
4,795,710 A * 1/1989 Muszak et al. ..... 211/163 X
4,909,400 A * 3/1990 Dubinsky ..... 211/70
5,009,336 A * 4/1991 Liaw ..... 211/70
5,074,421 A * 12/1991 Coulter ..... 211/163 X
5,076,444 A * 12/1991 Syms ..... 211/163 X
5,676,261 A * 10/1997 Baughman et al. ..... 211/70
5,772,050 A * 6/1998 Shih ..... 211/163 X

* cited by examiner

*Primary Examiner*—Robert W. Gibson, Jr.
(74) *Attorney, Agent, or Firm*—Leong C. Lei

(57) ABSTRACT

A disassemblable rotary pen exhibition rack of the invention comprises a base plate, a support seat, a central shaft, a plurality of balls and a ball bearing cap, a rotary platform, and a paper holder to form a fashion exhibition rack after assembly. The rotary platform, sustained on the plurality of balls under the ball bearing cap, can rotate freely 360°. The rotary platform provides a plurality of pen holes to hold pens upright. While the rotary platform is rotating, the specific features and patterns are displayed to eyes of the visitors. Under the bottom of the base plate, there is a recess to contain the paper holder which can be drawn out the buyer wants to try writing of the pen on the paper.

2 Claims, 6 Drawing Sheets

(3~3)

(4~4)

DISASSEMBLABLE ROTARY PEN EXHIBITION RACK

BACKGROUND

The prior art of pen exhibition rack is fixed in place, offering no flexibility and changeability in fashion, making trouble for the buyer to go around and look at what is really displayed. In addition the paper for the buyer to try on the pen in most cases is hanging on the rack or placed beside the rack and the colorful graffiti written on the paper present an adverse sense to aesthetics. Since the exhibition rack is not disassemblable, inconvenient for the pen manufacturer to bring it with him to attend the show in the foreign country.

SUMMARY OF THE INVENTION

A disassemblable rotary pen exhibition rack of the invention comprises a base plate, a support seat, a central shaft, a plurality of balls and a ball bearing cap, a rotary platform, a paper holder; in which, the base plate has a slot to house and hold the support seat. The support seat permits an easy insertion of the central shaft that sustains the rotary platform. The support seat provides a ball bearing tray together with a ball bearing cap to contain a plurality of balls therein. The balls are exposed to support the rotary platform, easy for rotary platform to rotate freely at 360°. The rotary platform provides a plurality of pen holes for vertical insertion of pen to be exhibited. While the rack is rotating, all excellent features and patterns of pen are showing up. At the bottom of the base plate, there is a slot for accommodating the paper holder which can be easily drawn out for the buyer to try on the pen on the paper. The pen exhibition rack of this invention is easy for assembly, display and presentation of novel pattern the pen inheres.

DETAILED DESCRIPTION OF THE INVENTION

Figure 1:
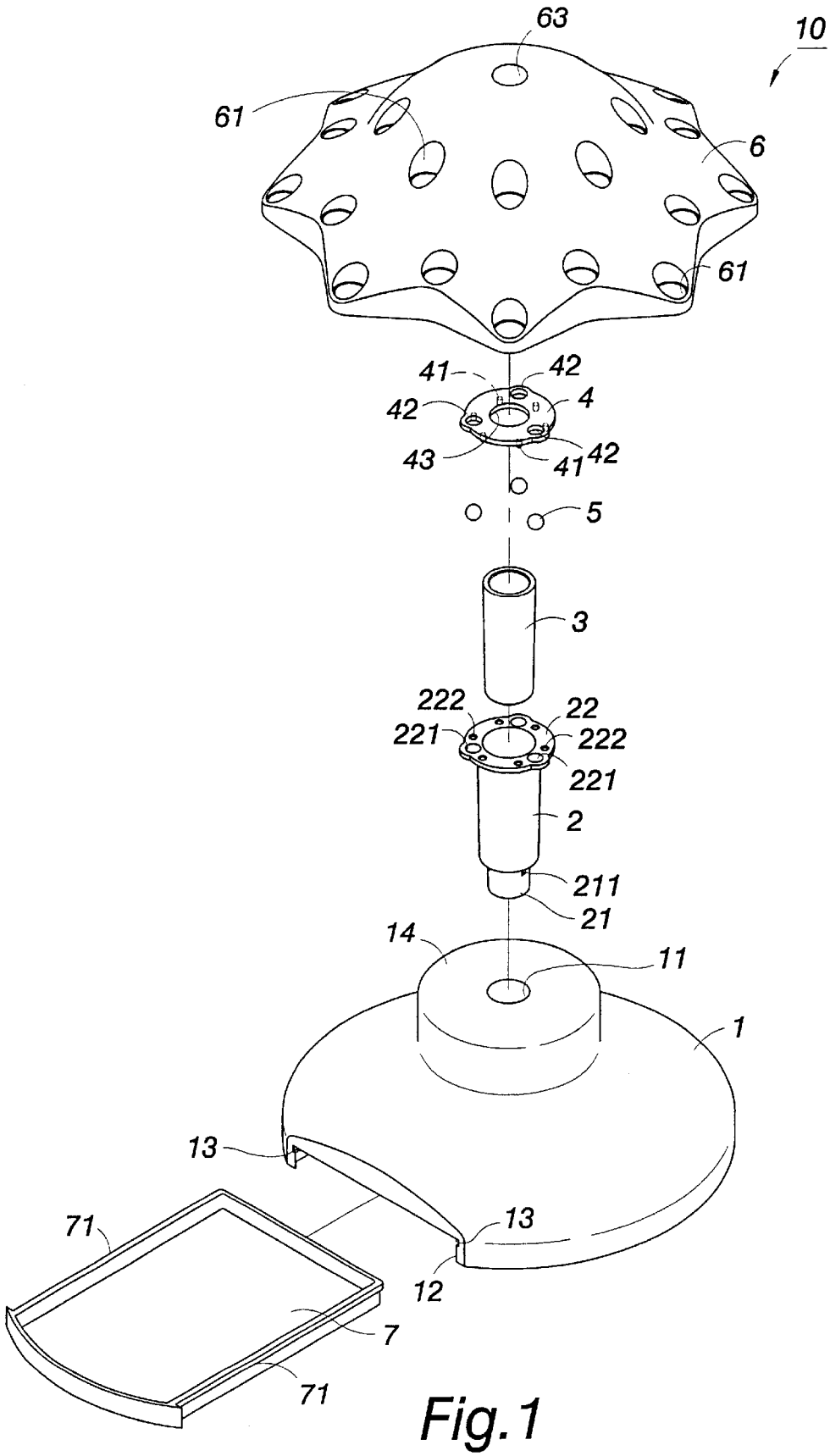
FIG. 1 is the schematic diagram of stereo disassembly of the pen exhibition rack of the invention.

The pen exhibition rack will be explained in great detail with the aid of the embodiments as illustrated in the drawings.

Figure 2:
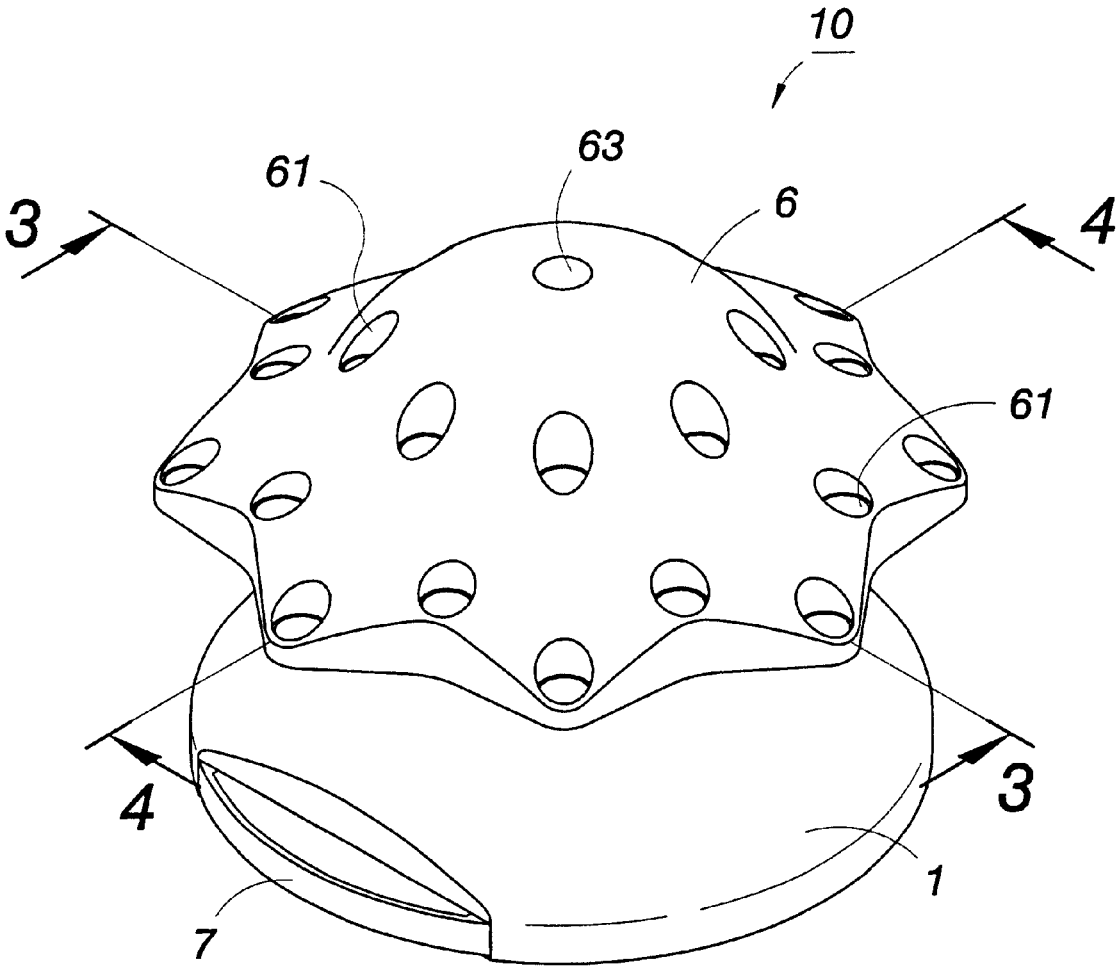
FIG. 2 is the schematic diagram of stereo assembly of the pen exhibition rack of the invention.

As shown in FIG. 1, the pen exhibition rack 10 constitutes a base plate 1, a support seat 2 having an inner ring 23 on the top, a central shaft 3, an outer ring 4, a plurality of balls 5, a rotary platform 6, and a paper holder 7. The complete assembly is shown in FIG. 2.

Figure 3:
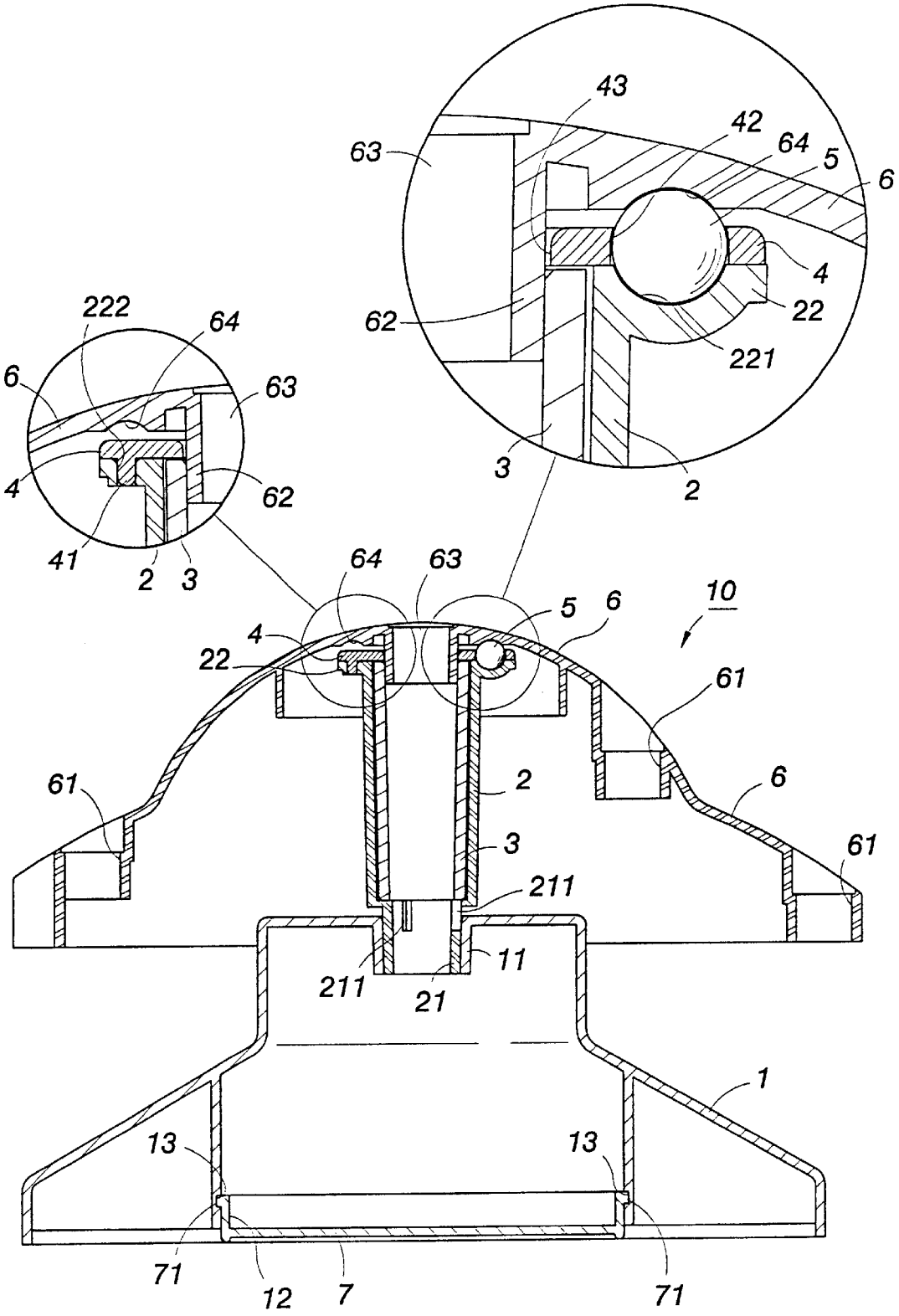
FIG. 3 shows the cross section viewed along 3—3 line of FIG. 2 of the pen exhibition rack of the invention.

Please refer to FIGS. 1 and 3. FIG. 3 shows the cross section of the pen exhibition rack of he invention displaying the arrangement of all relevant parts and components, where the base plate 1 has a projected seat 14 with a tapered hole 11 in the center. The support seat 2 is a section of central hollow tube with extended tapered end 21 which is inserted into the tapered hole 11 with perfect match. On the surface of the tapered end 21, there are three grooves 221 so that the tapered end 21 is able to produce the plasticity for easy disengaging the support seat 2 from the project seat 14. The support seat 2 permits the insertion of the central shaft 3. The central shaft 3 is also a section of central hollow tube with similar tapered angular form at the lower end as the support seat 2 has. The tapered end provides a tiny gap for the central shaft 3 to rotate freely within the support seat 2.

On the top of the support seat 2 is the ball tray 22 with a plurality of ball bearing grooves 221 and the retaining holes 222 for the balls 5 to sit in. The retaining holes 222 also allow the retaining post 41 beneath the ball bearing cap 4 to sit in. Both the ball bearing cap 4 and the retraining grooves furnish corresponding opening 42 to expose the ball 5 outside, allowing the rotary platform 6 rotating freely with the ring groove 64. When the rotary platform 6 is pushed forwardly by an extraneous force, it rotates 360° along the peripheral groove 64.

Figure 4:
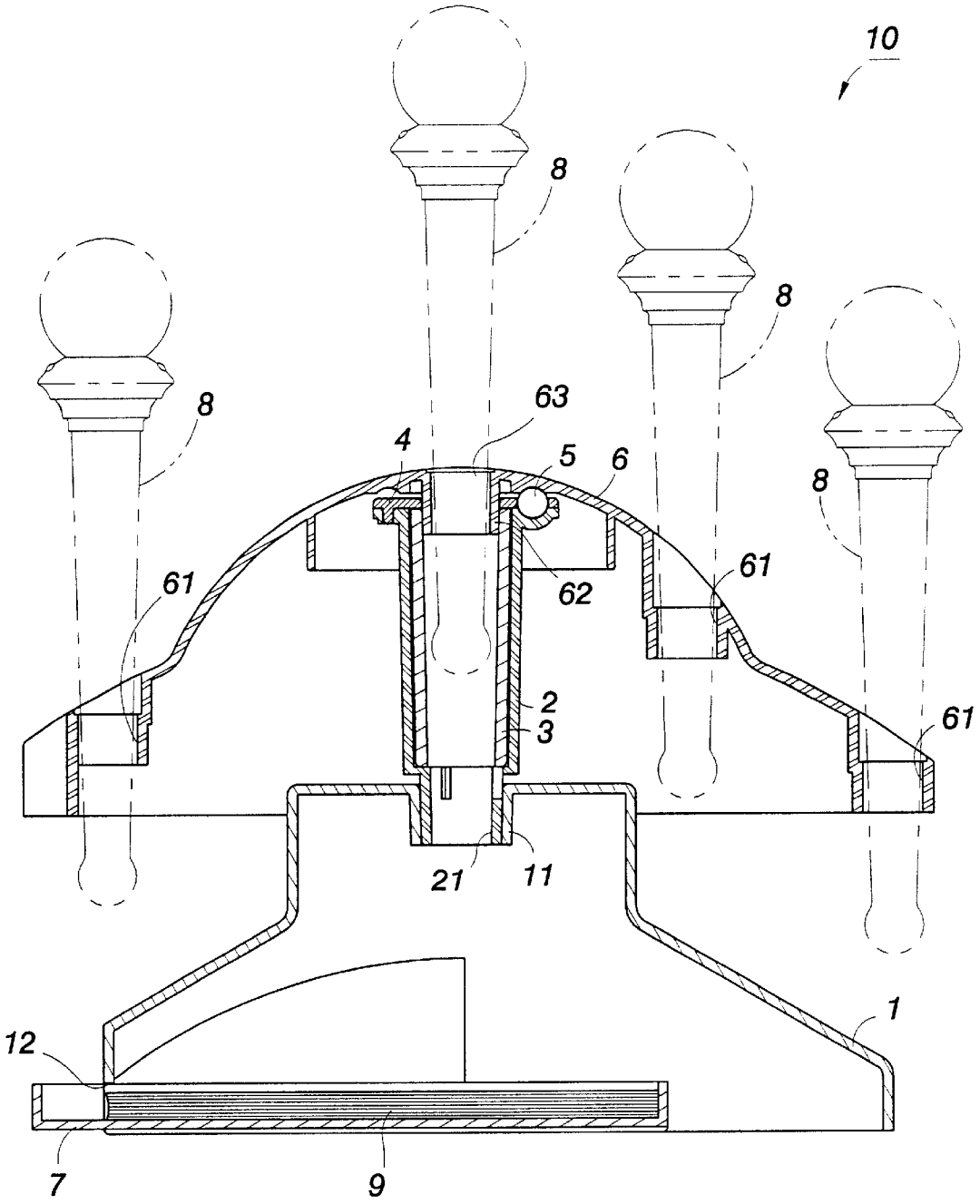
FIG. 4 shows the cross section viewed along 4–4 line of FIG. 2 of the pen exhibition rack of the invention.

On the bottom of the rotary platform 6 is a central hollow cam 62 which penetrates the central hole 43 on the ball bearing cap 4 and enters into the central shaft 3 as it fits in place so that central shaft 3 is forced to rotate by the rotation friction of the rotary platform 6. The rotary platform 6 is molded in the umbrella shape, a plurality of pen holes 61 are drilled on the top in a ladder layout for holding pen 8 therein (as shown in FIG. 4) so the visitors can have an clear view of what the features and the shape the pens look like.

The base plate 1 has a recess 12 on the bottom, with two slide indented tracks 13 mounted on both sides of the recess 12 to receive the shadow paper holder 7 and the writing paper 9 placed therein. The paper holder 7 has two projected flanges 71 which will slide into the indented tracks 13 of the recess 12. Since the paper holder 7 is hidden in the recess 12, this structure promotes beauty and practicability.

Figure 5:
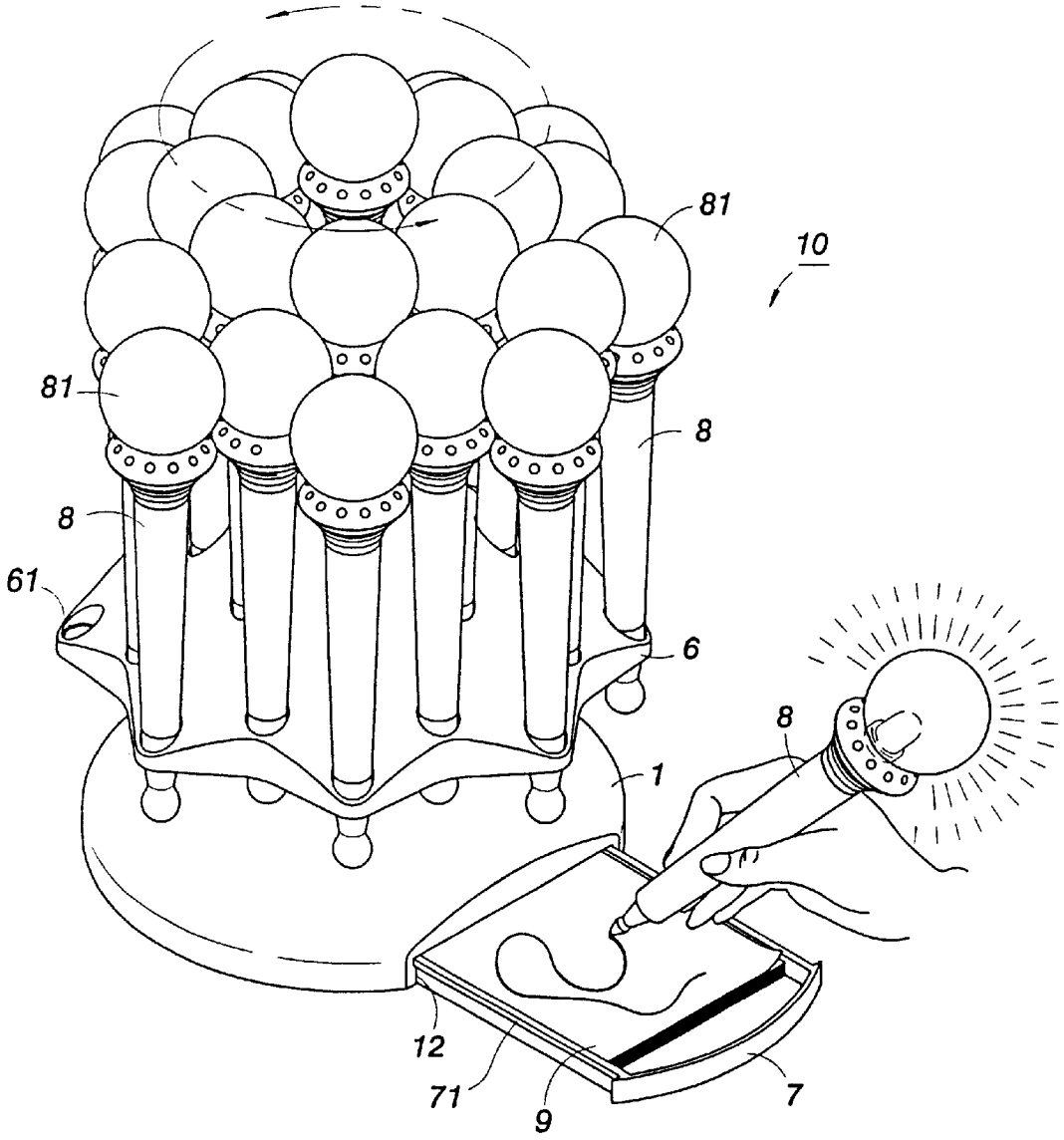
FIG. 5 is the stereo figure of the pen exhibition rack of the invention.
Figure 6:
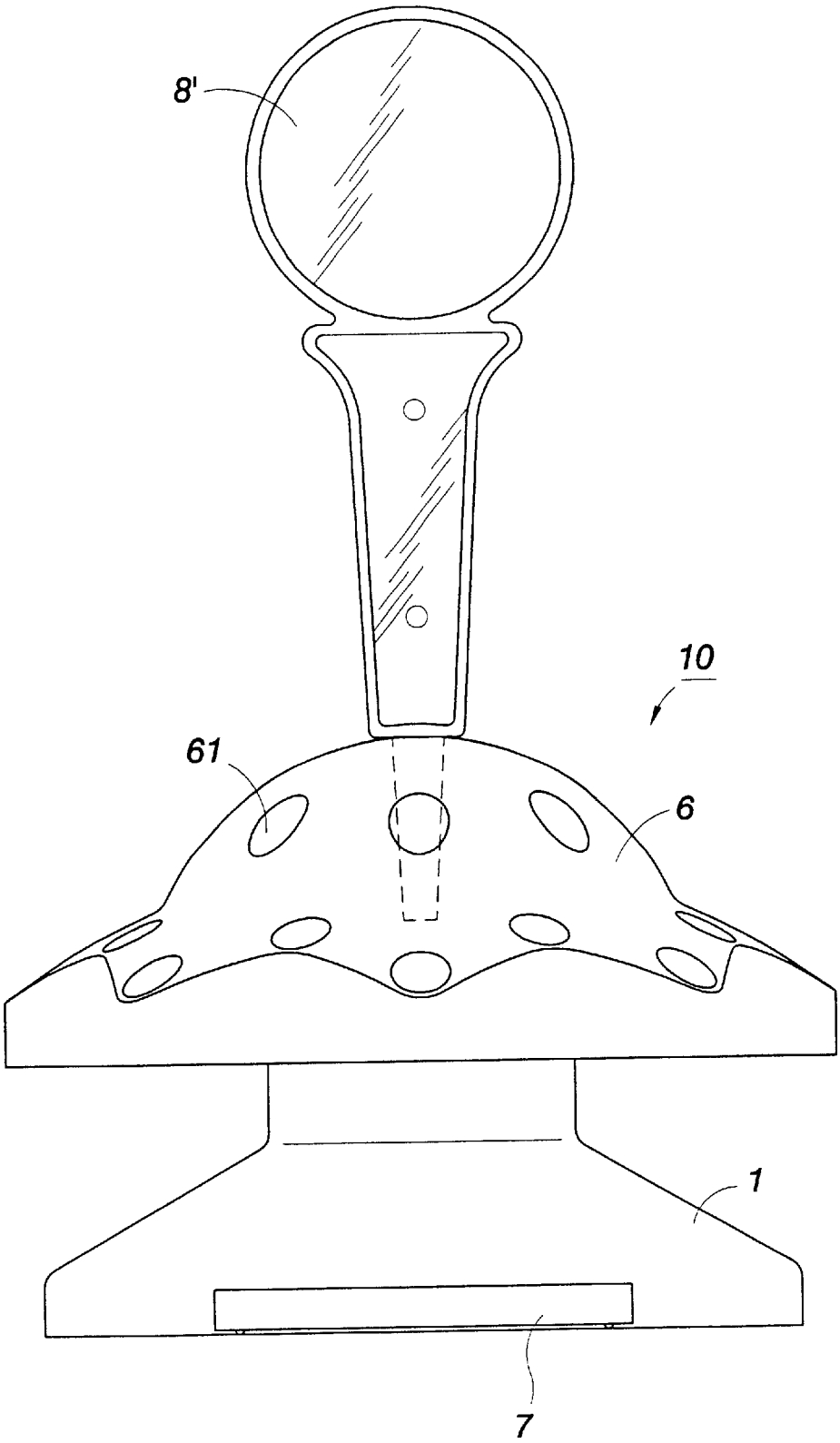
FIG. 6 is another embodiment of stereo figure of the pen exhibition rack of the invention.

FIG. 5 shows a practical embodiment of the pen exhibition rack in which, the rotary platform 6 can be pushed to rotate for choosing the pen 8. While the rotary platform 6 is rotating, the central shaft 3 is rotating too, where the balls 5 sustain the peripheral grooves 64 of the rotary platform 6 to rotate with minimum friction generated. The pen holes 63, aside from holding the pens, can hold a demonstration label 8' as shown in FIG. 8. The demonstration label 8' is in plan form, with beautiful printing on both sides to stimulate the buyers' desire to purchase such as the picture and description of an illuminating pen.

Since the exhibition rack is disassemblable, easy for the trader to disassemble and carry it with him wherever he goes. The rotary platform 6 and the pen can be made in many patterns with special effect. For example, if the decoration displayed in the pen hole is an ET, the platform is made to be a flying disk.; if the decoration is a space man, the platform 6 can be made to be a lunar module. So the rotary platform and the pen are cooperative to give the visitors a outstanding sense of beauty. The rotary platform 6 can match a variety of patterns of pen 8 without changing the entire exhibition rack. This way saves much in transpiration and packing.

The pen exhibition rack of this invention achieve at least the following objects.

1. The whole pen exhibition rack is a combination of parts with no bolts and pin, easy to assemble.
2. It matches the environment perfectly. It is a compact structure easy to disassemble or assemble, less space required, convenient for packing and shipping.

3. The pattern of the platform is easy toe change to couple with the pattern of the pen. For example, the platform can be made in the form of flying disk, the lunar module or the hamburger. The pen can be made in varying pattern to match with the rotary platform.
4. It rotates 360°, giving the visitors a comfortable observation and selection of the pen they desire.
5. The paper holder is hidden only available when in use. This way will not affect the integral sense of the beauty.

What is claimed is:

1. A disassemblable rotary pen exhibition rack comprising: a base plate, a main support for the exhibition rack, a support seat fixed on the base plate and having a ball bearing tray attached to a top thereof, a central shaft inserted into the support seat with adequate clearance between them, a plurality of balls placed in a groove on the ball bearing tray at equidistance, a ball bearing cap locked on the aforementioned ball bearing tray with notches to house the balls, the balls exposing and extending out of the notch, a rotary platform, fixed on the top of the central shaft and sustained by the balls, the ray platform is drilled with a plurality of pen holes, the base plate having a recess on a bottom thereof, which provides two slide indented tracks on both sides, and a paper holder to hold the paper, the ball bearing tray having a retaining hole, and the ball bearing cap having a retaining post that is locked into the retaining hole to integrate the ball bearing cap and tray into a united ball bearing.

2. The pen exhibition rack of claim 1, wherein the rotary platform has a projected hollow shaft that passes the central hole of the ball bearing cap and enters into the central shaft and stay there firmly, and a bottom of said hollow shaft has a peripheral groove sitting on the exposed portion of said balls for free rotation of the rotary platform.

* * * * *